US005137189A

United States Patent [19]

Hall et al.

[11] Patent Number: 5,137,189

[45] Date of Patent: Aug. 11, 1992

[54] POROUS REFRACTORY NOZZLE AND METHOD OF MAKING SAME

[75] Inventors: Richard G. Hall, Kylertown; Norman L. Sand, State College, both of Pa.

[73] Assignee: North American Refractories Company, Cleveland, Ohio

[21] Appl. No.: 409,738

[22] Filed: Sep. 20, 1989

[51] Int. Cl.[5] ..... B22D 41/58

[52] U.S. Cl. ..... 222/603; 266/220

[58] Field of Search ..... 266/217, 220, 270; 222/603

[56] References Cited

U.S. PATENT DOCUMENTS 4,756,452 7/1988 Tsukamoto et al. ..... 266/220
4,836,508 6/1989 Fishler ..... 266/220

FOREIGN PATENT DOCUMENTS 0028051 2/1987 Japan ..... 222/603
0834234 5/1960 United Kingdom ..... 222/603

*Primary Examiner*—S. Kastler
*Attorney, Agent, or Firm*—Jones, Day, Reavis & Pogue

[57] ABSTRACT

A nozzle for discharging molten metal from a vessel includes a porous inner sleeve surrounded by an impervious outer sleeve. The outer sleeve is cast in-situ around the inner sleeve, and is bonded in-situ to the outer surface of the inner sleeve in bonding areas adjacent its opposite ends. A gas chamber is defined between the inner and outer sleeves for receiving pressurized gas which passes through the inner sleeve to inhibit clogging and deterioration of the inner sleeve by molten metal and impurities. The gas chamber is formed by placing a heat fluidizable material around a portion of the inner sleeve before the outer sleeve is cast thereon. After casting of the outer sleeve, the assembly is heated to a temperature for fluidizing the fluidizable material which then escapes through the porous sleeve to leave a hollow gas chamber.

11 Claims, 2 Drawing Sheets

POROUS REFRACTORY NOZZLE AND METHOD OF MAKING SAME

BACKGROUND OF THE INVENTION

This application relates to the art of nozzles and, more particularly, to nozzles of the type used for discharging molten metal from a vessel.

Nozzles for discharging molten metal from a vessel are commonly made of a porous material through which an inert gas can be fed to inhibit clogging and deterioration of the porous material. It would be desirable to provide good support for a porous nozzle element to minimize cracking problems It would also be desirable to eliminate mortar joints in a porous nozzle assembly because gas tends to leak through such joints.

SUMMARY OF THE INVENTION

A nozzle of the type described for discharging molten metal from a vessel includes a refractory inner sleeve having a discharge passage through which molten metal is adapted to flow. The inner sleeve includes a peripheral wall that is permeable to gas, and has inner and outer surfaces and opposite ends.

A refractory outer sleeve includes a peripheral wall that is substantially impermeable to gas, and has inner and outer surfaces and opposite ends. The outer sleeve is cast in-situ around the inner sleeve, and the inner surface of the outer sleeve is bonded in-situ to the outer surface of the inner sleeve adjacent the opposite ends of the sleeves in circumferential bonded areas.

The outer wall of the inner sleeve and the inner wall of the outer sleeve are spaced from one another between the bonded areas to define a hollow space forming a gas chamber. Gas supply means is provided for supplying gas to the gas chamber through the peripheral wall of the outer sleeve. The gas may flow from the gas chamber through the gas permeable peripheral wall of the inner sleeve for discharge through the inner surface of the inner sleeve to inhibit deterioration and clogging of such inner surface by molten metal and impurities.

The outer sleeve is preferably surrounded by a metal jacket to which the outer sleeve is bonded in-situ.

In a preferred arrangement, the gas supply means is mounted to the outer surface of the inner sleeve prior to casting of the outer sleeve therearound. In one arrangement, the mounting means for the gas supply means includes a metal band tensioned around the inner sleeve and having the gas supply means attached thereto.

The gas chamber is formed between the inner and outer sleeves by placing a heat fluidizable material around a portion of the inner sleeve before casting the outer sleeve therearound. The assembly is then heated to fluidize the heat fluidizable material which escapes through the porous inner sleeve to leave the hollow gas chamber.

It is a principal object of the present invention to provide an improved porous nozzle and method of making same.

It is another object of the invention to provide a porous nozzle having an outer sleeve bonded in-situ to a porous inner sleeve.

It is an additional object of the invention to provide a porous nozzle having very good resistance to cracking.

DESCRIPTION OF A PREFERRED EMBODIMENT

Figure 1:
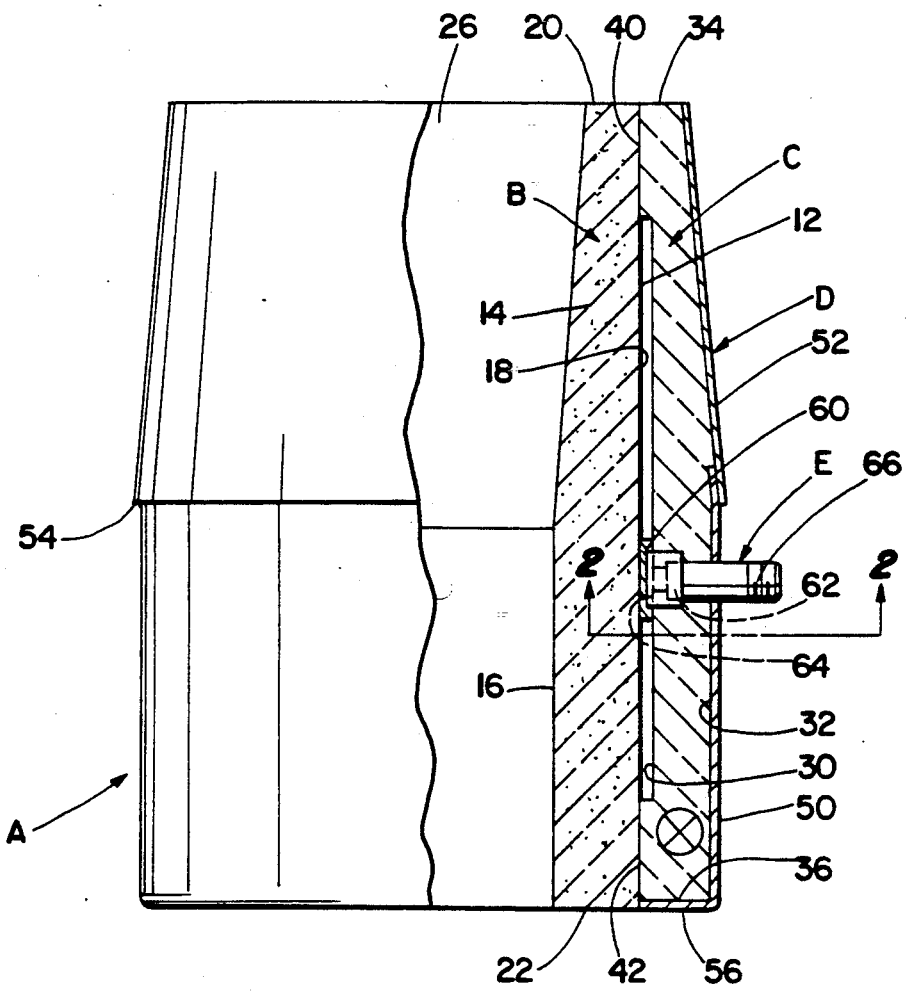
FIG. 1 is a partial cross-sectional elevational view of a nozzle constructed in accordance with the present application.
Figure 2:
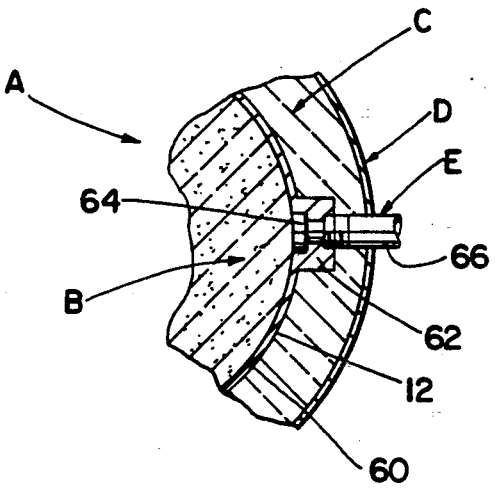
FIG. 2 is a partial cross-sectional view taken generally on line 2—2 of FIG. 1.

Referring now to the drawing, wherein the showings are for purposes of illustrating a preferred embodiment of the invention only and not for purposes of limiting same, FIG. 1 shows inner and outer sleeves B, C having a hollow space defining a gas chamber 12 therebetween. A metal jacket D surrounds outer sleeve C, and pressurized gas supply means E communicates with gas chamber 12 through outer sleeve C and metal jacket D.

Inner sleeve B includes a peripheral wall 14 having inner and outer surfaces 16, 18 and opposite ends 20, 22. Outer surface 18 is substantially cylindrical. Approximately one-half the axial length of inner surface 16 is cylindrical from end 22 toward end 20 and the other one-half has a generally inverted frusto-conical shape. In other words, the area of end 20 is smaller than the area of end 22, and inner surface 16 converges on itself from end 20 toward end 22 toward the axial center of nozzle A whereupon such inner surface becomes substantially cylindrical.

Inner sleeve B is porous and permeable to gas. Thus, pressurized gas supplied to gas chamber 12 flows through wall 14 of inner nozzle B to form a gas layer adjacent inner surface 16 for protecting same against clogging and deterioration as molten metal flows through the central passageway 26 therein in a direction from end 20 toward end 22.

Outer sleeve C has inner and outer surfaces 30, 32 and opposite ends 34, 36. Outer sleeve C is substantially impermeable to gas flow therethrough, and is intimately bonded in-situ to outer surface 18 of inner sleeve B at circumferential bonded areas 40, 42 adjacent opposite ends 20, 34 and 22, 42. Outer sleeve C is also intimately bonded in-situ to the inner surface of metal jacket D which is preferably of steel.

Inner surface 30 of outer sleeve C is substantially cylindrical and the portion thereof that cooperates to define gas chamber 12 is offset from the portions thereof that define circumferential bonded areas 40, 42. Outer surface 32 is substantially cylindrical for approximately one-half the axial length of nozzle A, and the upper portion thereof is of generally frusto-conical shape.

Jacket D has a substantially cylindrical lower portion 50 and a generally frusto-conical upper portion 52 that is circumferentially welded to lower portion 50 by a fillet weld 54. An integral inwardly extending circumferential flange 56 is provided on lower portion 50 and has a radial length approximately the same as the radial thickness of the wall of outer sleeve C adjacent end 36 thereof. Jacket D can also be of one-piece construction.

A metal strap 60 is tensioned around outer surface 18 of inner sleeve B and a gas distributor having gas outlets 64 is welded thereto. Outlets 64 are in communication with gas chamber 12. A pipe 66 connected with gas distributor 62 extends through outer sleeve C and through a suitable hole in lower portion 50 of jacket D. Metal strap 60 defines a mounting means for mounting gas supply means E to inner sleeve B. Metal strap 60 compressively engages outer surface 18 of inner sleeve B.

Figure 4:
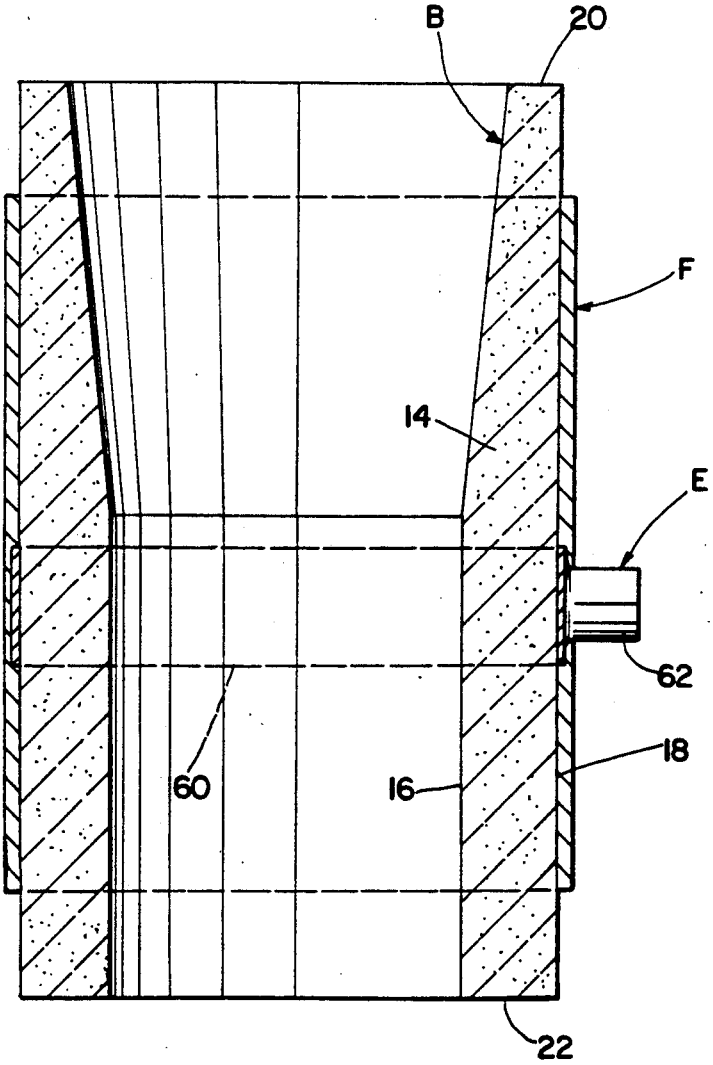
FIG. 4 is a cross-sectional elevational view showing a porous inner sleeve having a heat fluidizable material placed around the outer periphery thereof.

In making nozzle A, inner sleeve B is first cast, pressed and cured to the shape shown. With reference to FIG. 4, a heat fluidizable means F is then placed around outer periphery 18 of inner sleeve B in the desired size and shape for gas chamber 12 of FIG. 1. The gas fluidizable means F can take many forms including waxes and plastics. In one arrangement, the heat fluidizable material can be sheets of beeswax having a softening point of around 100° C. The sheet of beeswax is simply wrapped around outer surface 18 to the desired size and shape of the gas chamber. The beeswax is also positioned to block outlets 64 in gas distributor 62. Although it may be possible to use materials that melt or volatilize above 300° C., it is preferred that the material used will melt or volatilize below 300° C.

Metal jacket D is next positioned around inner sleeve B having the heat fluidizable material F thereon. Pipe 66 is then extended through the hole in jacket D and connected with gas distributor 62. The space between inner sleeve B and jacket D is then filled with refractory material to form outer sleeve C. The assembly is then heated to the melting point of heat fluidizable means F which escapes through porous inner sleeve B to leave a hollow space defining gas chamber 12. The material plugging gas distributor openings 64 also melts to clear such openings.

With the arrangement of the present application, gas chamber 12 can be located and sized to meet particular problems. For example, if clogging is found to occur at either the top or bottom of the nozzle, gas chamber 12 can be limited to those areas so that gas bubbling is concentrated where the clogging tends to occur. If there is no specific area of the nozzle passageway that is prone to clogging, the gas chamber can be made as large as possible in order to provide gas bubbles throughout the entire nozzle passageway.

Figure 3:
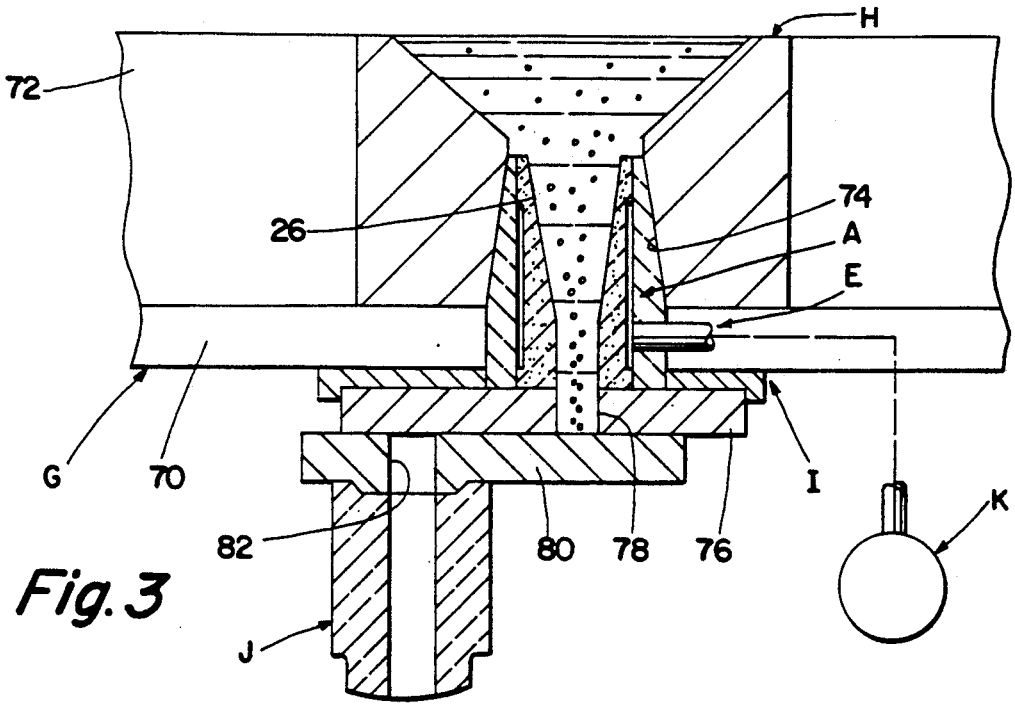
FIG. 3 is a partial cross-sectional elevational view showing the nozzle of FIG. 1 installed in a vessel.

FIG. 3 shows a vessel G for molten metal and having a vessel shell 70 that is lined with refractory 72. A nozzle seating block H has a cavity 74 therein shaped to correspond to the size and shape of nozzle A. Nozzle A is closely received in cavity 74 of nozzle seating block H and held therein by the mounting mechanism of a slide gate I in a known manner. The slide gate has a stationary upper plate 76 with an opening 78 therein aligned with passageway 26 in nozzle A. A slidable lower plate 80 has an opening 82 therethrough alignable with opening 78 to discharge molten metal through lower nozzle J. Gas supply means E is connected with a suitable source of pressurized gas K, such as argon or nitrogen.

A particularly advantageous arrangement of the present application includes forming of outer sleeve C by casting same in-situ around inner sleeve B. The refractory that forms outer sleeve C penetrates into the pores of inner sleeve B in circumferential bonded areas 40, 42 to intimately fuse therewith in-situ. This provides a substantially improved joint as compared to a mortar joint when joining inner and outer sleeves that are separately formed. The joint is characterized by having the refractory material of outer sleeve C penetrate into the open pores of inner sleeve B in circumferential bonded areas 40, 42.

Although other materials could be used for porous inner sleeve B, it preferably consists essentially of the ceramic oxides of aluminum, silicon, magnesium, calcium and zirconium. That is, $Al_2O_3$, $SiO_2$, MgO, CaO, and $ZrO_2$. The refractory is heat treated to produce a porosity of 20–30%, and a permeability of 500–1500 centidarcys. Examples of a suitable inner sleeve includes one that consists essentially of about 91% $Al_2O_3$ and about 8% $SiO_2$ with a porosity of about 24% and a permeability of 1000 centidarcys. Another example of a suitable material is one consisting essentially of about 73% $Al_2O_3$, about 24% $SiO_2$ and about 1.5% $Cr_2O_3$ with a porosity of 21% and a permeability of 850 centidarcys.

Outer sleeve C must be of a material having acceptable strength at both ambient and elevated temperatures. In addition, it must have a low permeability to insure that the gases pass only through porous inner sleeve B and not through outer sleeve C. In addition, the material forming outer sleeve C must bond extremely well to both porous inner sleeve B and to the inner surface of steel jacket D. Permeability of outer sleeve C is ideally 0, and should in any event be less than 100 centidarcys. An acceptable room temperature modulus of rupture should be greater than about 3.5 mega pascals. Acceptable hot strength should be greater than about 2 mega pascals at 1500° C. One example of an appropriate material is Narcocast LM 95 CC, available from the assignee of the present application. This material has a 0 permeability, a modulus of rupture of 23.6 mega pascals at 21 c and 5 mega pascals at 1500° C. The material also has a high fluidity when cast and provides excellent bonding to the porous inner sleeve B.

Obviously, pipe 66 can be mounted for communication with the gas chamber other than by use of strap 60 and gas distributor 62. For example, pipe 66 can have its inner end plugged with wax and extended into the wax used to form gas chamber 12. The pipe could be welded or otherwise secured to jacket D while the outer refractory sleeve is formed.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

We claim:

1. A discharge nozzle for discharging molten metal from a vessel comprising:

a refractory inner sleeve having a discharge passage through which molten metal is adapted to flow;

said inner sleeve including a peripheral wall that is permeable to gas and having inner and outer surfaces and opposite ends;

a refractory outer sleeve including a peripheral wall that is substantially impermeable to gas and having inner and outer surfaces;

said inner surface of said outer sleeve being bonded in-situ to said outer surface of said inner sleeve adjacent said opposite ends of said inner sleeve in circumferential bonded areas: that do not intersect said inner surface of said inner sleeve;

said outer wall of said inner sleeve and said inner wall of said outer sleeve being spaced from one another between said bonded areas to define a hollow space; and, gas supply means for supplying gas to said hollow space through said peripheral wall of said outer sleeve, whereby gas may flow from said hollow space through said gas permeable peripheral wall of said inner sleeve for discharge through said inner surface of said inner sleeve to inhibit deterioration and clogging of such inner surface.

2. The nozzle of claim 1 including a metal jacket bonded to said outer surface of said outer sleeve.

3. The nozzle of claim 1 including mounting means for mounting said gas supply means to said inner sleeve.

4. The nozzle of claim 3 wherein said mounting means includes a metal band compressively engaging a portion of said outer surface of said inner sleeve.

5. The nozzle of claim 1 wherein said hollow space has a radial thickness that is substantially less than the radial thickness of each of said peripheral walls on said inner and outer sleeves.

6. The nozzle of claim 1 wherein said inner sleeve has a porosity of 20–30% and a permeability of 500–1500 centidarcys.

7. The nozzle of claim 1 wherein said outer sleeve has a modulus of rupture at room temperature greater than 3.5 mega pascals and at 1500° C. greater than 2.0 mega pascals.

8. The nozzle of claim 1 wherein the composition of said inner sleeve consists essentially of one or more ceramic oxides of aluminum, silicon, magnesium, calcium and zirconium.

9. The nozzle of claim 8 wherein substantially more than one-half the composition of said inner nozzle is a ceramic oxide of aluminum.

10. The nozzle of claim 1 including a nozzle passage through which molten metal flows through said nozzle, said discharge passage through said inner sleeve defining the entire length of said nozzle passage, whereby said outer sleeve and said bonded areas are not directly exposed to contact by molten metal flowing through said nozzle passage.

11. The nozzle of claim 1 wherein said nozzle has a longitudinal axis, said inner surface of said inner sleeve having a generally frusto-conical portion extending along a substantial axial length thereof and sloping outwardly of said axis from a location intermediate said opposite ends of said inner sleeve to one of said opposite end, said outer surface of said outer sleeve having a generally frusto-conical portion sloping inwardly toward said axis from a location intermediate said opposite ends to said one opposite end.

* * * * *